US010249421B2

(12) United States Patent
Fujita

(10) Patent No.: US 10,249,421 B2
(45) Date of Patent: Apr. 2, 2019

(54) SUPERCONDUCTING COIL

(71) Applicant: FUJIKURA LTD., Tokyo (JP)

(72) Inventor: Shinji Fujita, Sakura (JP)

(73) Assignee: FUJIKURA LTD., Tokyo (JP)

( * ) Notice: Subject to any disclaimer, the term of this patent is extended or adjusted under 35 U.S.C. 154(b) by 112 days.

(21) Appl. No.: 15/507,546

(22) PCT Filed: Nov. 20, 2015

(86) PCT No.: PCT/JP2015/082710
§ 371 (c)(1),
(2) Date: Feb. 28, 2017

(87) PCT Pub. No.: WO2016/080524
PCT Pub. Date: May 26, 2016

(65) Prior Publication Data

US 2017/0309384 A1 Oct. 26, 2017

(30) Foreign Application Priority Data

Nov. 21, 2014 (JP) ..... 2014-236194

(51) Int. Cl.
*H01F 6/06* (2006.01)
*H01B 12/06* (2006.01)
(Continued)

(52) U.S. Cl.
CPC ..... *H01F 6/06* (2013.01); *H01B 12/06* (2013.01); *H01F 6/065* (2013.01); *H01R 4/68* (2013.01); *H01R 4/021* (2013.01)

(58) Field of Classification Search
CPC ..... H01F 6/06; H01B 12/06
See application file for complete search history.

(56) References Cited

U.S. PATENT DOCUMENTS

2009/0004916 A1* 1/2009 Miyoshi ..... H01R 13/5845 439/607.41
2013/0040819 A1 2/2013 Haraguchi et al.

FOREIGN PATENT DOCUMENTS

CN 102834878 A 12/2012
JP 2008-305861 A 12/2008
(Continued)

OTHER PUBLICATIONS

Extended European Search Report in counterpart European Application No. 15 86 1441.2 dated Mar. 12, 2018 (6 pages).
(Continued)

*Primary Examiner* — Paul A Wartalowicz
(74) *Attorney, Agent, or Firm* — Osha Liang LLP

(57) ABSTRACT

A superconducting coil, includes a coil body around which a superconducting wire is wound; an electrode member which includes a first surface, a second surface, a base portion, and an extension portion, the first surface facing an outer peripheral surface of the coil body, the second surface being positioned to be opposite to the first surface, the base portion being solder-joined to the superconducting wire of the coil body on the first surface, the extension portion extending from the second surface to the outside of the coil body, and an electrode superconducting wire which extends from the second surface of the electrode member toward the extension portion, and is solder-joined to the base portion and the extension portion.

11 Claims, 6 Drawing Sheets

(51) Int. Cl.
*H01R 4/68* (2006.01)
*H01R 4/02* (2006.01)

(56) References Cited

FOREIGN PATENT DOCUMENTS

| | | | |
|---|---|---|---|
| JP | 2009-049036 | A | 3/2009 |
| JP | 2010-098267 | A | 4/2010 |
| JP | 2011-228065 | A | 11/2011 |
| JP | 2012-164859 | A | 8/2012 |
| JP | 2014-017090 | A | 1/2014 |
| JP | 2014-143840 | A | 8/2014 |
| JP | 2014-150223 | A | 8/2014 |

OTHER PUBLICATIONS

Office Action in a counterpart Japanese Patent Application No. 2016-560302 dated Mar. 27, 2018 (2 pages).
Office Action in counterpart Chinese Patent Application No. 201580046161.7 dated Oct. 30, 2017 (7 pages).
Office Action in a counterpart Japanese Patent Application No. 2016-560302 dated Jun. 5, 2018 (3 pages).

* cited by examiner

SUPERCONDUCTING COIL

TECHNICAL FIELD

The present invention relates to a superconducting coil.

Priority is claimed on Japanese Patent Application No. 2014-236194, filed on Nov. 21, 2014, the content of which is incorporated herein by reference.

BACKGROUND ART

In recent years, as superconducting wires, oxide superconducting wires (hereinafter, simply referred to as superconducting wires) have been developed, which are referred to as bismuth-based superconducting wires such as Bi2212 ($Bi_2Sr_2CaCu_2O_{8+\delta}$) or Bi2223 ($Bi_2Sr_2Ca_2Cu_3O_{10+\delta}$) or yttrium-based superconducting wires such as RE123 ($REBa_2Cu_3O_{7-\delta}$), RE: rare earth element, for example, yttrium). Since the superconducting wires can be used in a relatively high temperature region, application development to superconducting coils is advanced. As a superconducting wire, a wire which is formed in a tape shape is known, and a superconducting coil which uses the superconducting wire, a pancake coil, a double pancake coil, or a superconducting coil in which a plurality of these coils are laminated had been developed.

In the superconducting coil, an electrode for supplying current to the wound superconducting wire is provided. Since the electrode is formed of a normal conductive member, a structure for decreasing heat generation from the electrode is required. For example, in a superconducting coil disclosed in Patent Document 1, an end portion of a wound superconducting wire is drawn out and is soldered so as to follow an electrode formed in an L shape. Accordingly, heat generation in the electrode is decreased.

PRIOR ART DOCUMENTS

Patent Documents

[Patent Document 1] Japanese Unexamined Patent Application, First Publication No. 2012-164859

SUMMARY OF THE INVENTION

Problems to be Solved by the Invention

In general, in a superconducting coil, after a superconducting wire is wound, the superconducting wire is impregnated with a resin. Accordingly, in order to drawn out the superconducting wire from the superconducting coil, it is necessary to peel off the superconducting wire from the impregnating resin near the end portion of the superconducting coil. As a result of this work, a load is applied to an oxide superconductor of the superconducting wire, and there is a concern that superconducting characteristics may deteriorate.

In addition, a conductive member may be disposed around the superconducting coil such as a case where the superconducting coil is interposed between metal flanges for cooling a coil or the like from an upper surface and a lower surface of the conducting coil. If an electrode approaches the conductive member, there is a concern that discharging from the electrode to the flanges may be generated, withstand voltage of the superconducting coil decreases. Accordingly, in a case where the electrode is provided along an outer periphery of the superconducting coil, it is necessary to solder the electrode such that the electrode is within a height size of the superconducting coil, which requires a great deal of labor.

The present invention is made in consideration of the above-described circumstances of the conventional art, and an object thereof is to provide a superconducting coil in which heat generation in an electrode decreases, deterioration of superconducting characteristics does not easily occur, and withstand voltage can be increased by an easy work process.

Means for Solving the Problems

In order to achieve the object, a superconducting coil according to an aspect of the present invention, includes: a coil body around which a superconducting wire is wound; an electrode member which includes a first surface, a second surface, a base portion, and an extension portion, the first surface facing an outer peripheral surface of the coil body, the second surface being positioned to be opposite to the first surface, the base portion being solder-joined to the superconducting wire of the coil body on the first surface, the extension portion extending from the second surface to the outside of the coil body; an electrode superconducting wire which extends from the second surface of the electrode member toward the extension portion and is solder-joined to the base portion and the extension portion, in which a relationship among a width W1 of the superconducting wire of the coil body, a width W2 of the base portion of the electrode member, and a width W3 of the electrode superconducting wire satisfies $W1>W2\geq W3$.

According to the configuration of the aspect, since the electrode superconducting wire is solder-joined to the electrode member, current which flows to the electrode member is bypassed by the electrode superconducting wire, and it is possible to decrease heat generation of the electrode member.

In addition, according to the configuration of the aspect, the electrode member is solder-joined to the superconducting wire positioned on the outer peripheral surface of the coil body. Accordingly, since the electrode member can be joined to the superconducting wire by exposing only one surface of the superconducting wire positioned on the outer peripheral surface of the coil body, even in a case where a resin is impregnated into the coil body, a load is not easily added to the superconducting wire. Accordingly, in a connection process of the electrode member, deterioration of the superconducting characteristics does not easily occur.

Moreover, according to the configuration of the aspect, width sizes of the electrode member and the electrode superconducting wire are smaller than a width size of the superconducting wire of the coil body. Therefore, the electrode member does not protrude from an upper end and a lower end of the coil body in a width direction (with respect to the width size) of the coil body. Accordingly, even in a case where the coil body is interposed between conductive flanges, or the like, a distance between the flanges, and the electrode member and the electrode superconducting wire is secured, and it is possible to increase the withstand voltage of the superconducting coil.

The electrode member may include a third surface which extends in a direction intersecting a direction in which the second surface extends and a boundary portion which is positioned between the second surface and the third surface, and the electrode superconducting wire may be solder-joined to the base portion and the extension portion to cover the second surface, the third surface, and the boundary portion.

The relationship between a critical current density value Ic1 of the coil body and a critical current density value Ic2 of the electrode superconducting wire may satisfy Ic2≥Ic1.

In a case where the critical current density value of the electrode superconducting wire is lower than the critical current density value of the coil body, if current equal to or more than the critical current density value of the electrode superconducting wire flows to the coil body, the current flows to the electrode member, there is a concern that heat may be generated in the electrode member. According to the configuration of the aspect, since the critical current density value of the electrode superconducting wire is higher than the critical current density value of the coil body, current can flow to the superconducting coil up to the critical current density value of the coil body. Accordingly, it is possible to sufficiently exert capability of the superconducting coil.

Moreover, as described above, in the superconducting coil according to the aspect, the width of the electrode superconducting wire is narrower than the width of the superconducting wire of the coil body. It is possible to select the electrode superconducting wire by defining the width of the electrode superconducting wire based on the critical current density value of the superconducting wire.

A groove which extends from the second surface of the electrode member toward the extension portion and is larger than a width of the electrode superconducting wire over the base portion and the extension portion may be provided, and the electrode superconducting wire may be solder-joined to the base portion and the extension portion inside the groove.

According to the configuration of the aspect, since the solder-joining can be performed in a state where the electrode superconducting wire is disposed along the groove of the electrode member, workability of the solder-joining increases. In addition, the electrode superconducting wire is not disposed to be inclined with respect to the electrode member, and it is possible to prevent the electrode superconducting wire from protruding from the upper end and the lower end of the coil body in the width direction of the coil body. Accordingly, it is possible to reliably secure the withstand voltage of the superconducting coil.

Moreover, in the electrode member, since the superconducting wire of the coil body is solder-joined to the first surface and the electrode superconducting wire is solder-joined to the second surface, current flows in the thickness direction of the electrode member. Therefore, a distance between wires is decreased by thinning the electrode member, and it is possible to decrease a connection resistance. On the other hand, the electrode member needs to have a predetermined thickness in order to obtain sufficient rigidity which is not easily deformed by its own weight or a weak external force. Since the groove is provided in the electrode member, it is possible to increase second moment of area with respect to an axis of the electrode member in the thickness direction, and it is possible to increase rigidity of the electrode member. Since the groove is provided, in the electrode member, a distance between wires decreases while sufficient rigidity is provided, and it is possible to decrease connection resistance.

The superconducting wire may include a first base material, a first oxide superconducting layer which is provided on the first base material, and a first stabilizing layer which is provided on the first oxide superconducting layer, the electrode superconducting wire may include a second base material, a second oxide superconducting layer which is provided on the second base material, and a second stabilizing layer which is provided on the second oxide superconducting layer, the first stabilizing layer may be solder-joined to face the first surface of the electrode member, and the second stabilizing layer may be solder-joined to face the second surface of the electrode member.

According to the configuration of the aspect, since the superconducting wire has a lamination structure, it is possible to easily manufacture a superconducting wire having a thin width by only cutting the superconducting wire in the width direction. Accordingly, it is possible to easily form an electrode superconducting wire having a thin width with respect to the superconducting wire of the coil body.

An outer periphery of the electrode superconducting wire may be coated with copper.

According to the configuration of the aspect, since the electrode superconducting wire is coated with copper, not only current characteristics of the electrode superconducting wire can be stabilized, and but also the inside of the electrode superconducting wire can be sealed to prevent moisture intrusion and deterioration of superconducting characteristics due to moisture can be prevented. In addition, copper has favorable compatibility with respect to solder and high bondability with respect to solder. Since the outer periphery of the electrode superconducting wire is coated with copper, solder spreads to the side portion of the electrode superconducting wire when the electrode superconducting wire and the electrode member are joined to each other, joining strength between the electrode superconducting wire and the electrode member increases, and it is possible to prevent the electrode superconducting wire from being separated from the electrode member.

The superconducting wire of the coil body may be joined to the electrode member by a first solder member, the electrode member may be joined to the electrode superconducting wire by a second solder member, and a melting point of the first solder member is different from a melting point of the second solder member.

According to the configuration of the aspect, after the electrode member and the wire are soldered by one solder member having a high melting point, the electrode member and the wire can be soldered by other solder member having a low melting point. When the joining is performed by the solder member having a low melting point, the solder member having a high melting point is not melted by melting the solder at a lower temperature than that of the solder member having a high melting point. Accordingly, the wire can be solder-joined to each of the first surface and the second surface of the electrode member.

Effects of Invention

According to the aspect, since the electrode superconducting wire is solder-joined to the electrode member, current which flows to the electrode member is bypassed by the electrode superconducting wire, and it is possible to decrease heat generation of the electrode member. In addition, since the electrode member can be joined to the superconducting wire by exposing only the stabilizing layer of the superconducting wire positioned on the outer peripheral surface of the coil body, a load is not easily added to the superconducting wire. Accordingly, in the connection process of the electrode member, deterioration of the superconducting characteristics does not easily occur. Moreover, since the width sizes of the electrode member and the electrode superconducting wire are smaller than the width size of the superconducting wire of the coil body, the distance between the conductive member and the electrode member is secured around the coil body, and it is possible to increase withstand voltage of the superconducting coil.

EMBODIMENTS FOR CARRYING OUT THE INVENTION

Figure 1:
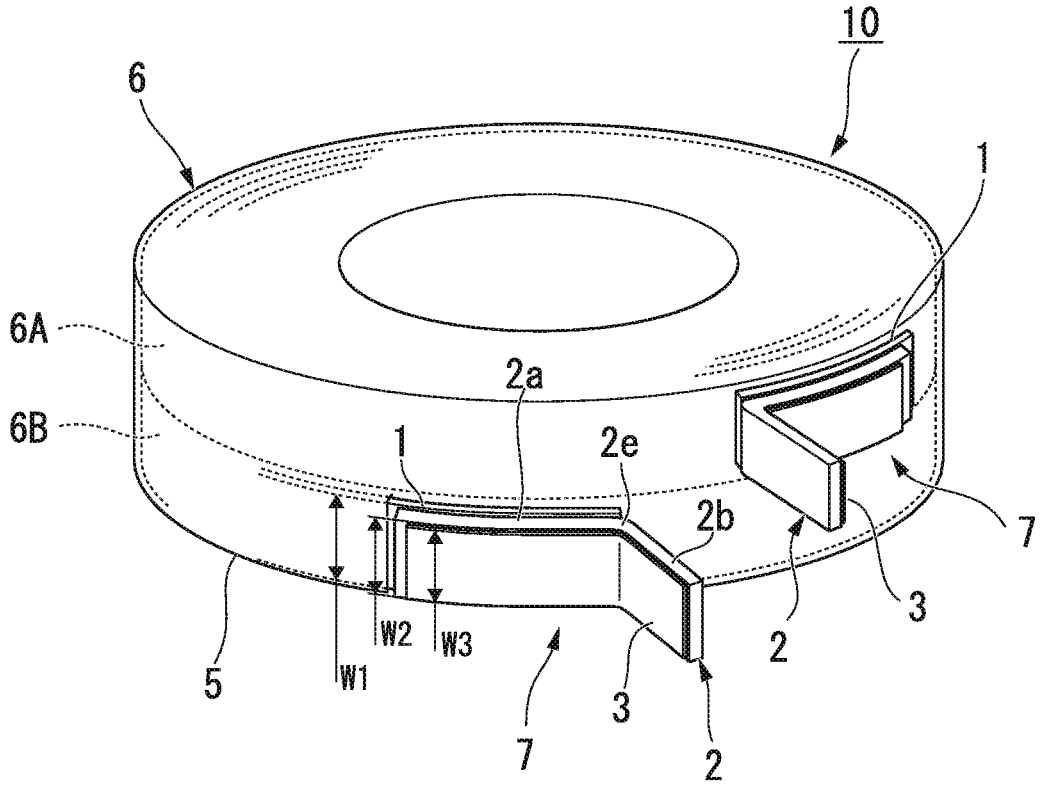
FIG. 1 is a schematic perspective view showing a structure of an example of a superconducting coil according an embodiment.

Hereinafter, a superconducting coil according to an embodiment of the present invention will be described with reference to the drawings. In addition, in the drawings used in descriptions below, for easy understanding of features, characteristic portions may be enlarged for the sake of convenience, and the size ratio of each component or the like is not limited to a case of being the same as an actual size ratio.

FIG. 1 is a schematic perspective view showing a structure of an example of a superconducting coil 10 according an embodiment of the present invention. The superconducting coil 10 includes a coil body 6 in which a first coil 6A and a second coil 6B are coaxially laminated to each other such that the first coil 6A is provided on the second coil 6B, and two electrode joint portions 7. The coil body 6 is covered by an impregnating resin 5.

The first coil 6A is a pancake-shaped coil in which a superconducting wire 1 is concentrically and circularly wound many times in the clockwise direction. The second coil 6B is a pancake-shaped coil in which a superconducting wire 1 is concentrically and circularly wound many times in the counterclockwise direction.

A winding start end of the first coil 6A and a winding start end of the second coil 6B, which are respectively positioned inside the coils 6A and 6B, are disposed to be adjacent to each other, and the winding start ends are electrically and mechanically connected to each other by a connection plate (not shown) having good conductivity to form the coil body 6. Moreover, electrode members 2 are joined to winding terminal ends positioned on the outermost peripheries of the coils 6A and 6B to form the electrode joint portions 7. In each electrode joint portion 7, an electrode superconducting wire 3 is joined to the electrode member 2.

The coil body 6 is fixed by the impregnating resin 5 and has a strong structure against stress due to a magnetic field. As the impregnating resin 5, a thermosetting resin such as an epoxy resin, a phenol resin, a urea resin, or a melamine resin can be used. Accordingly, it is possible to improve mechanical strength (coil rigidity) of the superconducting coil 10.

Figure 2:
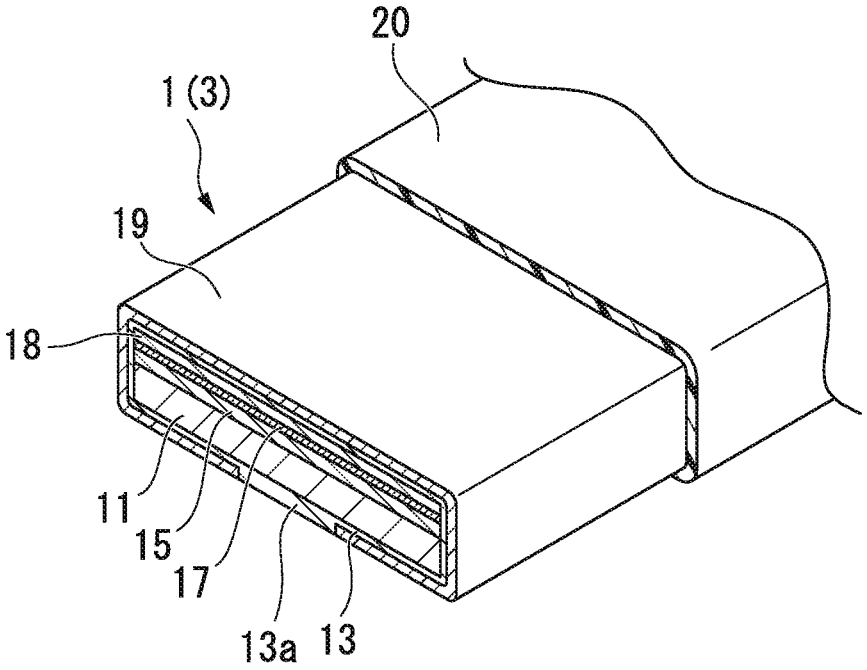
FIG. 2 is a schematic perspective view showing a structure of an example with respect to a superconducting wire and an electrode superconducting wire included in the superconducting coil shown in FIG. 1.

FIG. 2 is a schematic perspective view showing an example of the structure of the superconducting wire 1 included in the superconducting coil 10.

In the present embodiment, as the superconducting wire 1, an yttrium based oxide superconducting wire is exemplified. The superconducting wire 1 has a structure in which an intermediate layer 15, an oxide superconducting layer 17, and a protective layer 18 are laminated on a taper-shaped base material 11 and a stabilizing layer 19 is laminated on at least the protective layer 18. In addition, the superconducting wire 1 is wound as the coils 6A and 6B in a state of being covered with an insulating coating layer 20. As shown in FIG. 1, in the superconducting wire 1 of each of the coils 6A and 6B, the impregnating resin 5 and the coating layer 20 on the stabilizing layer 19 on the winding terminal end side of each of the coils 6A and 6B are removed, and the electrode member 2 is joined onto the exposed stabilizing layer 19.

As the base material 11, a nickel alloy represented by Hastelloy (trade name, manufactured by Haynes Corporation, USA), stainless steel, and textured Ni—W alloy obtained by introducing a texture to a nickel alloy are applied. The thickness of the base material 11 may be appropriately adjusted according to the purpose and may be in the range of 10 to 500 μm.

The intermediate layer 15 is formed on the upper surface of the base material 11. As an example, the intermediate layer 15 may have a structure in which a diffusion prevention layer, a bed layer, a textured layer, and a cap layer are laminated in this order from the base material 11 side. However, the intermediate layer 15 may have a configuration in which one or both of the diffusion prevention layer and the bed layer are omitted.

The oxide superconducting layer 17 may be a material known as an oxide superconductor, and specifically, $REBa_2Cu_3O_y$ (RE is a rare earth element) referred to as RE-123 system can be exemplified.

The protective layer 18 is a layer formed of Ag or an Ag alloy formed on the upper surface of the oxide superconducting layer 17. The protective layer 18 function as protecting the oxide superconducting layer 17 and function as bypassing an overcurrent generated during the accident.

The stabilizing layer 19 is formed at least on the upper surface of the protective layer 18. The stabilizing layer 19 according to the present embodiment is formed by covering a laminate configured of the base material 11, the intermediate layer 15, the oxide superconducting layer 17, and the protective layer 18 in a substantially C-shaped cross section with a metal tape. The stabilizing layer 19 is joined with a solder layer 13 interposed therebetween on the outer periphery (in four direction is a cross section) of the laminate configured of the base material 11, the intermediate layer 15, the oxide superconducting layer 17, and the protective layer 18. An embedded portion 13*a* in which the molten solder layer 13 is embedded is formed in a portion which is not covered with the stabilizing layer 19 (that is, a portion between the side end portions of the metal tape). The thickness of the metal tape configuring the stabilizing layer 19 is not particularly limited and can be appropriately adjusted, but the thickness of the metal tape may be 10 to 300 μm.

The stabilizing layer 19 is made of a material having good conductivity. For example, it is preferable to use a material configured of a relatively inexpensive material such as copper, brass, copper alloy such as Cu—Ni alloy, stainless steel or the like. The stabilizing layer 19 functions as a bypass in which the current of the oxide superconducting layer 17 is commutated, along with the protective layer 18.

Moreover, the stabilizing layer 19 may be formed by soldering a metal tape only to the upper surface of the protective layer 18. In addition, the stabilizing layer 19 may be formed by a known method such as a plating method or a sputtering method.

The superconducting wire 1 configured as described above is wound as the coils 6A and 6B in a state in which the coating layer 20 surrounding the entire periphery is formed. For example, the coating layer 20 can be formed by spirally winding an insulating tape such as a polyimide tape so as to surround the entire periphery of the superconducting wire 1.

As the method of winding the insulating tape, in addition to the method of winding the insulating tape in a spiral manner, there is a method of surrounding by a co-winding or the like.

The superconducting wire 1 according to the present embodiment is wound in a coil shape in a state where the base material 11 is positioned inward and the stabilizing layer 19 is positioned outward. Accordingly, the stabilizing layer 19 of the superconducting wire 1 is disposed outward on a winding terminal end portion of the superconducting wire 1. In addition, if the stabilizing layer 19 is positioned outward in the winding terminal end portion, the superconducting wire 1 in which the front surface and the rear surface are inversely disposed inside the coils 6A and 6B may be used so as to be connected. That is, the coils 6A and 6B may be manufactured by winding a wire which is connected to a superconducting wire which is wound in a coil shape in a state where the base material 11 is positioned outward in the winding start end portion and in which the base material 11 is positioned inward midway.

Figure 3:
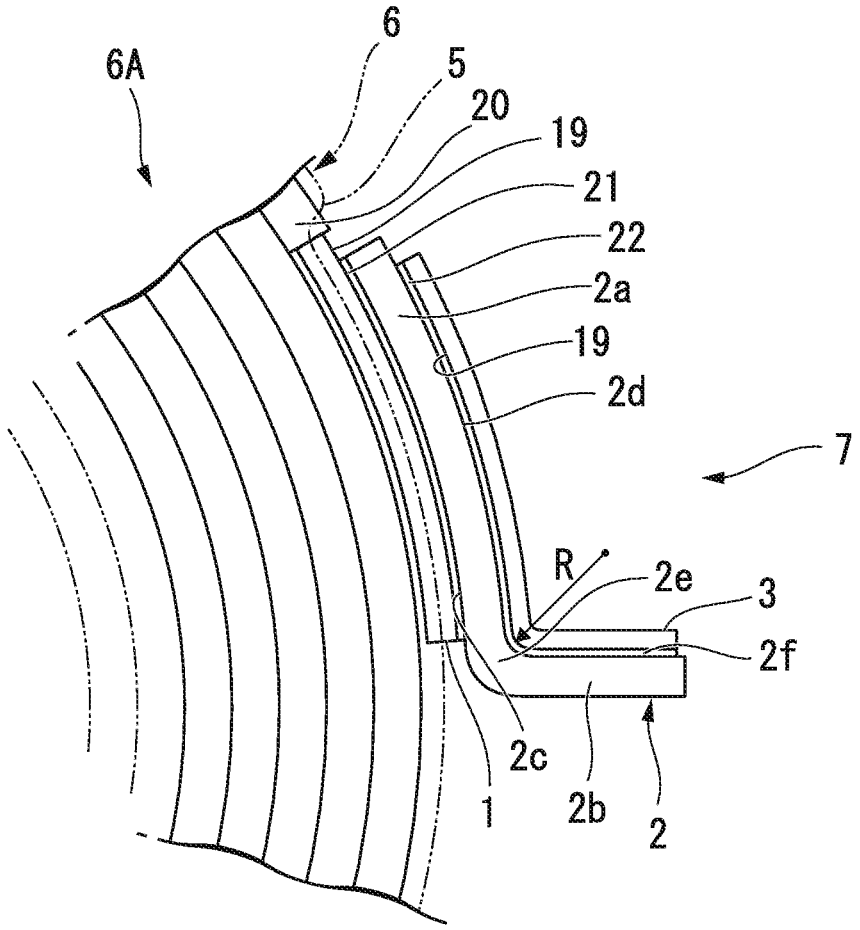
FIG. 3 is a top view schematically showing a structure of an electrode joint portion of the superconducting coil shown in FIG. 1.

In the winding terminal end portion of the superconducting wire 1 configured as described above, the electrode member 2 is joined onto the stabilizing layer 19 of the superconducting wire 1 to form the electrode joint portion 7. FIG. 3 is a top view schematically showing a structure of an electrode joint portion 7 in the superconducting coil 10 according to the present embodiment. In addition, since the structures of the electrode joint portions 7 of the first coil 6A and the second coil 6B are the same as each other except that winding directions of the superconducting wires 1 configuring the coil bodies are opposite to each other and joining directions of the electrode members 2 in the electrode joint portions 7 are opposite to each other in the peripheral directions, in the following descriptions, the structure of the electrode joint portion 7 of the first coil 6A will be described as an example.

FIG. 3 is a top view schematically showing the structure of an electrode joint portion 7 in the superconducting coil 10 shown in FIG. 1. In FIG. 3, the impregnating resin 5 is indicated by a two-dot chain line.

As shown in FIG. 3, in the first coil 6A, the impregnating resin 5 and the coating layer 20 covering the outer periphery of the superconducting wire 1 are removed in the winding terminal end portion of the superconducting wire 1. The stabilizing layer (first stabilizing layer) 19 of the superconducting wire 1 according to the present embodiment is provided so as to cover the outer periphery of the laminate configured of the base material (first base material) 11, the intermediate layer (first intermediate layer) 15, the oxide superconducting layer (first oxide superconducting layer) 17, and the protective layer (first protective layer) 18. It is sufficient that the removal of the impregnating resin 5 and the coating layer 20 is performed such that the surface positioned on the outer periphery side of the coil 6A in the stabilizing layer 19 positioned on the entire periphery of the superconducting wire 1 is exposed. In addition, since the coil 6A is wound in a state where the base material 11 is positioned inward, the surface on the oxide superconducting layer 17 side (close to the oxide superconducting layer 17) of the stabilizing layer 19 is exposed. The electrode member 2 is solder-joined to the exposed stabilizing layer 19 (first stabilizing layer) with a first solder member 21 interposed therebetween.

The electrode member 2 is formed in an L shape, and the electrode member 2 includes a base portion 2*a* which is disposed along the winding terminal end portion of the superconducting wire 1 of the first coil 6A and an extension portion 2*b* which extends from one end of the base portion 2*a* to the outside of the coil body 6. Moreover, the electrode member 2 has a first surface 2*c* as a front surface, and a second surface 2*d* (a surface on the base portion 2*a*) and a third surface 2*f* (a surface on the extension portion 2*b*) as a rear surface, with respect to the entire length extending over the base portion 2*a* and the extension portion 2*b*. In addition, the electrode member 2 has a boundary portion 2*e* between the base portion 2*a* and the extension portion 2*b*. In the electrode member 2, the third surface 2*f* extends in a direction intersecting a direction in which the second surface 2*d* extends, and the boundary portion 2*e* (a surface on the inner angle side of the boundary portion, a curved portion) is positioned between the second surface 2*d* and the third surface 2*f*. A portion of the first surface 2*c* faces the outer peripheral surface of the coil body 6.

The base portion 2*a* of the electrode member 2 is solder-joined to the exposed stabilizing layer (first stabilizing layer) 19 of the superconducting wire 1, in which the impregnating resin 5 and the coating layer 20 are removed, on the first surface 2*c*. The electrode member 2 is joined to the superconducting wire 1 by the first solder member 21.

In addition, the electrode member 2 is solder-joined to the electrode superconducting wire 3 over the base portion 2*a* and the extension portion 2*b* so as to cover the second surface 2*d*, the third surface 2*f*, and the boundary portion 2*e* (the surface on the inner angle side of the boundary portion, the curved portion) by the electrode superconducting wire 3 on the second surface 2*d* and the third surface 2*f*. The electrode member 2 is joined to the electrode superconducting wire 3 by the second solder member 22.

As the electrode member 2, a material known in the conventional art may be used, a metal having high conductivity, for example, copper, silver, gold, platinum, or an alloy containing at least one of these metals may be used, and among these, copper which is inexpensive and has excellent conductivity is preferable. In addition, the electrode member 2 may be a member in which the surface is plated with any one of solder, Sn, Ag, and Au. Preferably, the electrode member 2 has a predetermined thickness in order to obtain sufficient rigidity that is not easily deformed by its own weight or a weak external force. For example, the thickness of the electrode member 2 is approximately 1 mm to 5 mm. In addition, as described in detail later, preferably, a width W2 of the base portion 2*a* of the electrode member 2 is narrower than a width W1 of the superconducting wire 1. That is, preferably, W1>W2 is satisfied (refer to FIG. 1 or the like).

Since the electrode superconducting wire 3 is provided so as to be solder-joined to the base portion 2*a* and the extension portion 2*b* of the electrode member 2, the electrode superconducting wire 3 bypasses current which flows to the electrode member 2. Accordingly, the electrode superconducting wire 3 has a function which decreases the current flowing to the electrode member 2 and decreases heat generation of the electrode member 2.

The electrode superconducting wire 3 has a layer structure similar to that of the superconducting wire 1 of the coil 6A. That is, as shown in FIG. 2, the electrode superconducting wire 3 has the structure in which the intermediate layer 15, the oxide superconducting layer 17, and the protective layer 18 are laminated on the base material 11 having a tape shape and the stabilizing layer 19 is provided on at least the protective layer 18. However, the coating layer 20 is not provided on the outer periphery of the electrode superconducting wire 3.

Preferably, the stabilizing layer (second stabilizing layer) 19 of the electrode superconducting wire 3 is provided so as to cover the outer periphery of the laminate configured of the base material (second base material) 11, the intermediate layer (second intermediate layer) 15, the oxide superconducting layer (second oxide superconducting layer) 17, and the protective layer (second protective layer) 18 (refer to FIG. 2). In addition, preferably, the stabilizing layer 19 uses copper which has high conductivity and is relatively inexpensive. That is, preferably, the electrode superconducting wire 3 has a structure in which the outer periphery is coated with copper. Copper has favorable compatibility with respect to solder and high bondability with respect to solder. Since the outer periphery of the electrode superconducting wire 3 is coated with copper, solder spreads to the electrode superconducting wire 3 when the electrode superconducting wire 3 and the electrode member 2 are joined to each other, joining strength between the electrode superconducting wire 3 and the electrode member 2 increases, and it is possible to prevent the electrode superconducting wire 3 from being separated from the electrode member 2. Moreover, since the electrode superconducting wire 3 has the structure in which the outer periphery is coated with copper, it is possible to stabilize current characteristics. In addition, the inside of the electrode superconducting wire can be sealed by the copper to prevent moisture intrusion, and deterioration of superconducting characteristics due to moisture can be prevented.

In the electrode superconducting wire 3, the stabilizing layer (second stabilizing layer) 19 positioned on the oxide superconducting layer 17 side is joined to the second surface 2*d* in the base portion 2*a* of the electrode member 2 and the third surface 2*f* in the extension portion 2*b* of the electrode member 2, by the second solder member 22. As described in detail later, preferably, a width W3 of the electrode superconducting wire 3 is the same as or is narrower than the width W2 of the electrode member 2. That is, preferably, W2≥W3 is satisfied (refer to FIG. 1 or the like).

Since the electrode superconducting wire 3 is solder-joined to the base portion 2*a* and the extension portion 2*b* of the electrode member 2, the electrode superconducting wire 3 is curved along the boundary portion 2*e* between the base portion 2*a* and the extension portion 2*b*. In a bending radius R of the electrode superconducting wire 3 in the curved portion, for example, preferably, the bending radius R is 5 mm or more, and more preferably, the bending radius R is within a range of 6 to 16 mm. It is possible to prevent decreases in superconducting characteristics by setting the bending radius R of the electrode member 2 to the range. In addition, it is possible to cause the electrode joint portion 7 to be compact without increasing the sizes of the electrode joint portion 7.

Since the bending radius R of the electrode superconducting wire 3 depends on the curvature radius on the inner angle side in the boundary portion 2*e*, preferably, the curvature radius on the inner angle side of the boundary portion 2*e* is determined such that the bending radius R of the electrode superconducting wire 3 is within the above-described range.

Preferably, a critical current density value Ic2 of the electrode superconducting wire 3 is the same as a critical current density value Ic1 of the coil body 6 or is higher than the critical current density value Ic1. That is, preferably, Ic2≥Ic1 is satisfied. In a case where the critical current density value Ic2 of the electrode superconducting wire 3 is lower than the critical current density value Ic1 of the coil body 6, if current which is equal or more than the critical current density value of the electrode superconducting wire 3 flows to the superconducting coil 10, the current flows to the electrode member 2, and there is a concern that heat generation may occur in the electrode member 2. Since the critical current density value Ic2 of the electrode superconducting wire 3 is higher than the critical current density value Ic1 of the coil body 6, current can flow to the superconducting coil 10 up to the critical current density value Ic1 of the coil body 6. Accordingly, it is possible to sufficiently exert the capability of the superconducting coil 10.

In addition, the critical current density value Ic1 of the coil body 6 does not necessarily coincide with the critical current density value of the wound superconducting wire 1. Since the coil body 6 is formed by winding the superconducting wire 1, if current flows to the coil body 6, a large magnetic field is added. Due to this magnetic field, the critical current density value Ic1 of the coil body 6 may be lower than the critical current density value of the superconducting wire 1.

In the superconducting coil 10, the width W3 of the electrode superconducting wire 3 is narrower than the width W1 of the superconducting wire 1 of the coil body 6. In general, if the thickness of each layer is constant, the critical current density value of the superconducting wire decrease as the width becomes narrow. Preferably, the width W3 of the electrode superconducting wire 3 is set such that a critical current density value Ic3 of the electrode superconducting wire 3 is equal to or more than the critical current density value Ic2 of the coil body 6. In addition, preferably, the width W2 of the electrode member 2 is set such that W2≥W3 is satisfied according to the width W3 of the electrode superconducting wire 3.

The superconducting wire 1 of the coil body 6 and the electrode member 2 are joined to the each other by the first solder member 21. In addition, the electrode member 2 and the electrode superconducting wire 3 are joined to each other by the second solder member 22. Preferably, the melting points of the first solder member 21 and the second solder member 22 are different from each other.

For example, in a case where the melting point of the first solder member 21 is higher than the melting point of the second solder member 22, first, the superconducting wire 1 of the coil body 6 and the electrode member 2 are joined to each other by the first solder member 21. Next, the second solder member 22 is melted at a temperature which is equal to or more than the melting point of the second solder member 22 and is equal to or less than the melting point of the first solder member 21, and the electrode member 2 and the electrode superconducting wire 3 are joined to each other by the second solder member 22. In this procedure, the superconducting wire 1 and the electrode superconducting wire 3 can be solder-joined to the first surface 2*c*, the second surface 2*d*, and the third surface 2*f* of the electrode member 2 without melting the first solder member 21 by joining the electrode superconducting wire 3.

In addition, the kind of solder of each of the first solder member 21 and the second solder member 22 is not particularly limited and, for example, may be Sn, Sn—Pb based alloy solder, lead-free solder such as Sn—Ag based alloy, Sn—Bi based alloy, Sn—Cu based alloy, and Sn—In based alloy, eutectic solder, low temperature solder, or the like. In addition, these solders may be used alone or combinations of two or more may be used.

Figure 4:
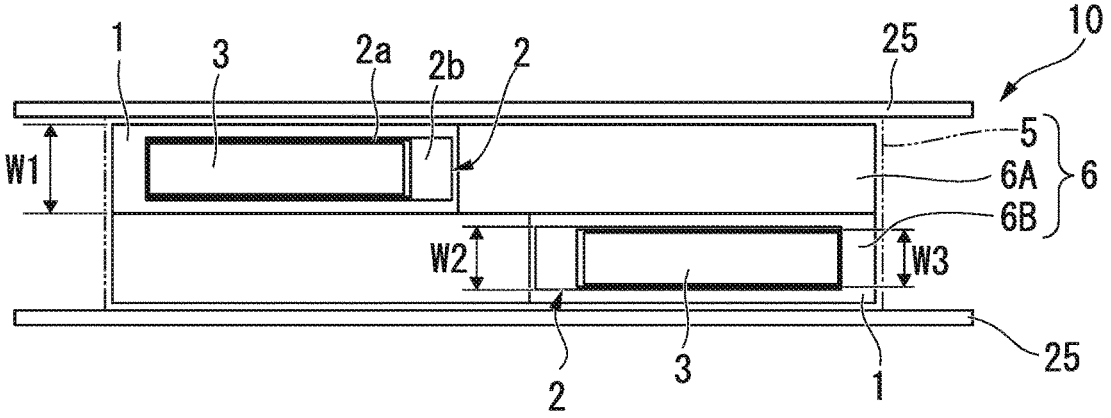
FIG. 4 is a front view of the superconducting coil shown in FIG. 1.

Next, a relationship among the width W1 of the superconducting wire 1 of the coil body 6, the width W2 of the base portion 2*a* of the electrode member 2, and the width W3 of the electrode superconducting wire 3 will be described in detail with reference to the FIG. 4. FIG. 4 is a front view of the superconducting coil 10. Similarly to FIG. 3, in FIG. 4, the impregnating resin 5 is indicated by two-dot chain lines. As shown in FIG. 4, a cooling flange 25 is disposed on each of the upper surface and the lower surface of the superconducting coil 10. The flange 25 is configured of a metal material for increasing cooling efficiency.

As shown in FIG. 4, in the superconducting coil 10, the relationship between the width W1 of the superconducting wire 1 of the coil body 6 and the width W2 of the base portion 2*a* of the electrode member 2 satisfies W1>W2. That is, the width size (W2) of the base portion 2*a* of the electrode member 2 is narrower than the width size (W1) of the superconducting wire 1 of the coil body 6. By satisfying this relationship, the base portion 2*a* of the electrode member 2 does not protrude from the upper end and the lower end of the coil body 6 in the width direction (with respect to the width size) of the coil body 6.

In addition, in the superconducting coil 10, the relationship between the width W2 of the base portion 2*a* of the electrode member and the width W3 of the electrode superconducting wire 3 satisfies W2≥W3. That is, the width size (W3) of the electrode superconducting wire 3 is equal to or less than the width size (W2) of the base portion 2*a* of the electrode member 2. By satisfying this relationship, the electrode superconducting wire 3 is settled in the width direction of the base portion of the electrode member 2.

According to the above-described configuration, even in a case where in the superconductive coil 10, the coil body is interposed between the conductive flanges 25 on the upper surface and the lower surface of the superconducting coil 10, it is possible to secure a distance between the flanges 25, and the electrode member 2 and the electrode superconducting wire 3. If the electrode member 2 and the electrode superconducting wire 3 approach the flanges 25, there is a concern that discharging from the electrode member 2 to the flanges 25 may be generated. Since the distance between the flanges 25, and the electrode member 2 and the electrode superconducting wire 3 is secured, it is possible to increase withstand voltage of the superconducting coil 10.

In addition, here, attention is paid to the width W2 of the base portion 2*a* of the electrode member 2. However, preferably, the electrode member 2 is constant over the entire area and the width W2 of the base portion 2*a* and the width of the extension portion 2*b* are the same as each other.

Accordingly, the extension portion 2*b* of the electrode member 2 does not approach the flanges 25, and it is possible to increase the withstand voltage.

In addition, each of the superconducting wire 1 and the electrode superconducting wire 3 according to the present embodiment includes the base material 11, the oxide superconducting layer 17 provided on the base material 11, and the stabilizing layer 19 provided on the oxide superconducting layer 17. In a case where the superconducting wire having the lamination structure is adopted, it is possible to easily narrow the superconducting wire by only cutting the superconducting wire in the width direction. Accordingly, it is possible to easily manufacture the narrow electrode superconducting wire 3 with respect to the superconducting wire 1 of the coil body 6.

MODIFICATION EXAMPLE

Figure 5A:
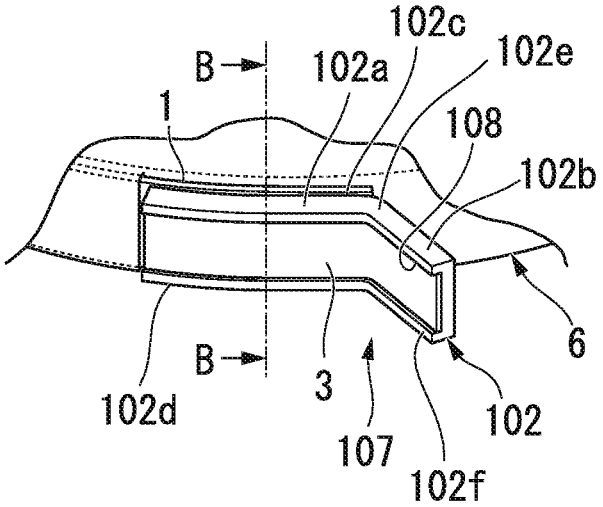
FIG. 5A is a view showing an electrode member of a modification example which can be applied to the superconducting coil shown in FIG. 1, and a perspective view of an electrode joint portion including the electrode member of the modification example.
Figure 5B:
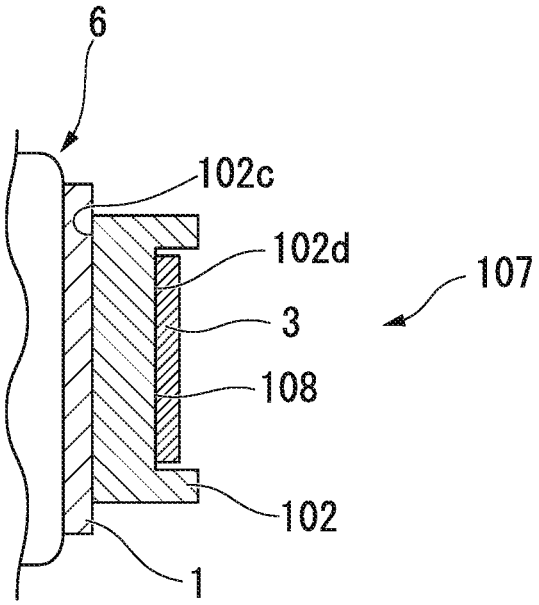
FIG. 5B is a sectional view taken along line B-B of FIG. 5A.

FIGS. 5A and 5B are views showing an electrode member 102 of a modification example which can be adopted in the above-described superconducting coil 10. FIG. 5A is a perspective view of an electrode joint portion 107 included in the electrode member 102, and FIG. 5B is a sectional view taken along line B-B of FIG. 5A. The same reference numerals are assigned to the components similar to those of the above-described embodiment, and descriptions thereof are omitted. In addition, in FIG. 5B, the first solder member 21 by which the electrode member 102 and the superconducting wire 1 are joined to each other and the second solder member 22 by which the electrode member 102 and the electrode superconducting wire 3 are joined to each other are not shown.

The electrode member 102 has a structure which is substantially similar to that of the above-described electrode member 2, but is different from the electrode member 2 in that a groove 108 is provided.

The electrode member 102 is formed in an L shape including a base portion 102*a* which is disposed along the winding terminal end portion of the superconducting wire 1 of the coil body 6 and an extension portion 102*b* which extends from one end of the base portion 102*a* to the outside of the coil body 6. Moreover, the electrode member 102 has a first surface 102*c* as a front surface, and a second surface 102*d* (a surface on the base portion 102*a*) as a rear surface and a third surface 102*f* (a surface on the extension portion 102*b*) as a rear surface, with respect to the entire length extending over the base portion 102*a* and the extension portion 102*b*. A portion of the first surface 102*c* faces the outer peripheral surface of the coil body 6 and is solder-joined to the superconducting wire 1 exposed from the outer peripheral surface of the coil body 6.

In addition, the electrode member 102 has a boundary portion 102*e* between the base portion 102*a* and the extension portion 102*b*. In the electrode member 102, the third surface 102*f* extends in a direction intersecting a direction in which the second surface 102*d* extends, and the boundary portion 102*e* (a surface on the inner angle side of the boundary portion, a curved portion) is positioned between the second surface 102*d* and the third surface 102*f*.

The groove 108 having a larger width than the width of the electrode superconducting wire 3 is provided on the second surface 102*d* in the base portion 102*a*, the third surface 102*f* in the extension portion 102*b*, and the boundary portion 102*e* (the surface on the inner angle side of the boundary portion, the curved portion). In the groove 108, the electrode superconducting wire 3 is solder-joined to the base portion 102*a* and the extension portion 102*b* so as to cover the second surface 102*d*, the third surface 102*f*, and the boundary portion 102*e* (the surface on the inner angle side of the boundary portion, the curved portion). The depth of the groove 108 is not particularly limited.

By providing the groove 108, since a worker can perform the solder-joining in a state where the electrode superconducting wire 3 is disposed along the groove 108 of the electrode member 102, workability of the solder-joining increases. Moreover, since the electrode superconducting wire 3 is accommodated in the groove 108, the electrode superconducting wire 3 is not disposed to be inclined to the electrode member 102. Accordingly, it is possible to prevent the electrode superconducting wire 3 from protruding from the upper end and the lower end of the coil body 6, and even in a case where flanges are disposed on the upper surface and the lower surface of the coil body 6, it is possible to reliably secure the withstand voltage of the superconducting coil 10.

In the electrode member 102, the superconducting wire 1 of the coil body 6 is solder-joined to the first surface 102*c*, and the electrode superconducting wire 3 is solder-joined to the second surface 102*d* and the third surface 102*f*. Current flows between the superconducting wire 1 and the electrode superconducting wire 3 in the thickness direction of the electrode member 102 inside the electrode member 102. Accordingly, the distance between the superconducting wire 1 and the electrode superconducting wire 3 with respect to the thickness direction of the electrode member 102 becomes an electric resistance. As the electrode member 102 is thinned and the distance between the superconducting wire 1 and the electrode superconducting wire 3 decreases, the electric resistance of the electrode joint portion 7 can be decreased. On the other hand, the electrode member 102 needs to have a predetermined thickness in order to obtain sufficient rigidity which is not easily deformed by its own weight or a weak external force. Since the groove 108 is provided in the electrode member 102, it is possible to increase second moment of area with respect to an axis of the electrode member 102 in the thickness direction, and it is possible to increase rigidity of the electrode member 102. By providing the groove 108, in the electrode member 102, a distance between the superconducting wire 1 and the electrode superconducting wire 3 decreases while sufficient rigidity is provided, and it is possible to decrease a connection resistance.

Hereinbefore, the embodiment of the present invention is described, and the configurations in the embodiment and combination thereof are exemplified. Accordingly, addition, omission, replacement, and other modifications of the configurations can be applied within a scope which does not depart from the present invention. In addition, the present invention is not limited to the embodiment.

Figure 6:
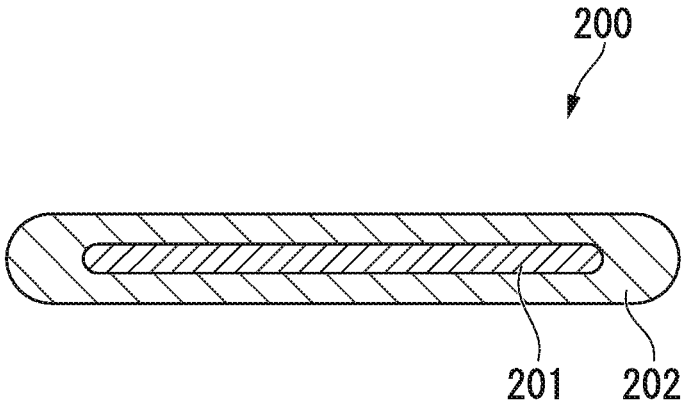
FIG. 6 is a sectional view showing a structure of an example of a bismuth-based superconducting wire.

For example, in the embodiment, it is described that the superconducting wire has the configuration in which the oxide superconducting layer configured of a superconductor referred to as RE-123 base (or yttrium base) is laminated on the base material. The type of the superconducting wire is not limited to the configuration, and as shown in FIG. 6, a bismuth-based superconducting wire 200 may be adopted. The superconducting wire 200 has a structure manufactured by a roll rolling method or the like so that the oxide superconducting layer 201 configured of a bismuth-based superconductor is covered with a sheath material 202 of Ag.

Moreover, although the coil body according to the above-described embodiment has a structure in which two coils are laminated, the coil body may have a structure configured of only one coil or a structure in which three or more coils are laminated.

In the above-described embodiment, the electrode member has a structure in which the extension portion is disposed on the distal end side (the position close to the distal end) of the superconducting wire of the coil body. However, the extension portion may be configured to be disposed on the side opposite to the distal end of the superconducting wire. Moreover, the structure in which the electrode member is formed in an L shape by the base portion and the extension portion is exemplified. However, the electrode member may have a T-shaped structure in which the extension portion is disposed at the center in the longitudinal direction of the base portion.

EXAMPLE

Hereinafter, the present invention will be described in more detail with reference to Examples. However, the present invention is not limited to the Examples.

(Manufacturing of Sample)

First, a superconducting wire wound as a coil was manufactured.

An intermediate layer was formed on a base material made of a tape-shaped Hastelloy (trade name, manufactured by Haynes Corporation, USA) having a width of 5 mm and a thickness of 75 μm. For the intermediate layer, $Al_2O_3$ (diffusion prevention layer), $Y_2O_3$ (bed layer), MgO (textured layer (IBAD layer)) and $CeO_2$ (cap layer) were formed in this order (in order). Next, $GdBa_2Cu_3O_{7-\delta}$ (oxide superconducting layer) was formed on the intermediate layer.

Next, a protective layer configured of Ag was formed on the oxide superconducting layer. Next, a copper tape having a thickness of 75 μm and a width of 5 mm was joined to the upper surface of the protective layer with Sn solder to form a stabilizing layer. A superconducting wire having a width of 5 mm was manufactured by the above processes. The critical current density value of this superconducting wire was measured, and as a result, the critical current density value was 250 A.

Next, a polyimide tape was wound around the outer periphery of the superconducting wire to form a coating layer, and insulation processing was performed. Next, this superconducting wire was wound 100 turns around a winding frame having a diameter of 50 mm so that the stabilizing layer was positioned outward to manufacture a coil (pancake coil). Next, two coils manufactured by the process were laminated and impregnated with an epoxy resin (impregnating resin) to form a coil body.

Next, in the winding terminal end portion of the superconducting wire wound around each coil, the impregnating resin and the coating layer were removed to expose the stabilizing layer. A pair of electrode members for forming an electrode joint portion in each coil was prepared, and the base portions of the electrode members were joined to the exposed stabilizing layers by a first solder member. Solder having a melting point of 184° C. was used as the first solder member. Moreover, for the electrode member, each of the base portion and the extension portion used a member having a width of 4 mm and a thickness of 3 mm.

Next, the electrode superconducting wire was solder-joined to each electrode member by a second solder member. The electrode superconducting wire has a layer structure similar to that of the above-described superconducting wire. However, the stabilizing layer of the electrode superconducting wire was formed so as to cover not only the upper surface of the protective layer but also the entire outer periphery of the protective layer (refer to FIG. 2). The width of the electrode superconducting wire was 3 mm. The critical current density value of the electrode superconducting wire was measured, and as a result, the critical current density value was 150 A.

The electrode superconducting wire was solder-joined so that the oxide superconducting layer side of the electrode superconducting wire faced the electrode member. The electrode superconducting wire was curved at the boundary between the base portion and the extension portion of the electrode member, and the bending radius of the electrode superconducting wire in the curved portion was 15 mm. Solder having a melting point of 130° C. was used as the second solder member.

The superconducting coil of the Example shown in FIG. 1 was manufactured by the above processes.

Next, a current lead was connected to each electrode member (the surface opposite to the third surface 2*f* which was the surface to which the electrode superconducting wire 3 was joined in the extension portion 2*b* of the electrode member 7) of the superconducting coil, and the critical current density value of the superconducting coil and the electric resistance of the electrode joint portion were measured in liquid nitrogen (liquid nitrogen temperature). As a result, the critical current density value of the superconducting coil was 89.0 A. In addition, the electrical resistance of the two electrode joint portions was 2.1 μΩ in total (the electrical resistance of each of the two electrode joint portions was measured, and the total of the electrical resistances of the two electrode joint portions was 2.1 μΩ). When the critical current density value (89.0 A) of the superconducting coil was reached, no nonlinear resistance component appeared in the electrode joint portion. Since the critical current density value of the superconducting coil is lower than the critical current density value (150 A) of the electrode superconducting wire, it is considered that the critical current density value of the coil body appeared as the critical current density value of the superconducting coil. That is, it is considered that the critical current density value of the coil body was 89.0 A.

In addition, for comparison with the superconducting coil of the Example, a superconducting coil of Comparative Example was produced.

A superconducting coil of Comparative Example which included the same configuration as that of the above-described superconducting coil and did not include an electrode superconducting wire was manufactured. A current lead was connected to the electrode member of the superconducting coil of the Comparative Example, and the critical current density value of the superconducting coil and the electric resistance of the electrode joint portion were measured in liquid nitrogen (liquid nitrogen temperature). As a result, the critical current density value of the superconducting coil was 88.7 A, and the electrical resistance of the two electrode joint portions was 12.5 μΩ in total (the electrical resistance of each of the two electrode joint portions was measured, and the total of the electric resistances of the two electrode joint portions was 12.5 μΩ). From the above results, it was confirmed that the electric resistance at the electrode joint portion could be decreased by using the superconducting coil of the Example.

DESCRIPTION OF REFERENCE NUMERAL

1, 200: superconducting wire
2, 102: electrode member
2*a*, 102*a*: base portion
2*b*, 102*b*: extension portion
2*c*, 102*c*: first surface
2*d*, 102*d*: second surface
2*e*, 102*e*: boundary portion
2*f*, 102*f*: third surface
3: electrode superconducting wire
5: impregnating resin
6: coil body
6A, 6B: coil
7, 107: electrode joint portion
10: superconducting coil
11: base material
15: intermediate layer
17, 201: oxide superconducting layer
18: protective layer
19: stabilizing layer
20: coating layer
21: first solder member
22: second solder member
25: flange
202: sheath material
R: bending radius
W1: width of superconducting wire
W2: width of base portion of electrode member
W3: width of electrode superconducting wire

The invention claimed is:

1. A superconducting coil, comprising:

a coil body around which a superconducting wire is wound;

an electrode member which comprises a first surface, a second surface, a base portion, and an extension portion, the first surface facing an outer peripheral surface of the coil body, the second surface being positioned to be opposite to the first surface, the base portion being solder-joined to the superconducting wire of the coil body on the first surface, the extension portion extending from the second surface to the outside of the coil body; and an electrode superconducting wire which extends from the second surface of the electrode member toward the extension portion, and is solder-joined to the base portion and the extension portion, wherein a relationship among a width W1 of the superconducting wire of the coil body, a width W2 of the base portion of the electrode member, and a width W3 of the electrode superconducting wire satisfies W1 >W2 ≥W3.

2. The superconducting coil according to claim 1, wherein the electrode member comprises a third surface which extends in a direction intersecting a direction in which the second surface extends and a boundary portion which is positioned between the second surface and the third surface, and wherein the electrode superconducting wire is solder-joined to the base portion and the extension portion to cover the second surface, the third surface, and the boundary portion.

3. The superconducting coil according to claim 1, wherein a relationship between a critical current density value Ic1 of the coil body and a critical current density value Ic2 of the electrode superconducting wire satisfies Ic2 ≥Ic1.

4. The superconducting coil according to claim 1, wherein a groove which extends from the second surface of the electrode member toward the extension portion and is larger than a width of the electrode superconducting wire over the base portion and the extension portion is provided, and the electrode superconducting wire is solder-joined to the base portion and the extension portion inside the groove.

5. The superconducting coil according to claim 1, wherein the superconducting wire comprises a first base material, a first oxide superconducting layer which is provided on the first base material, and a first stabilizing layer which is provided on the first oxide superconducting layer, wherein the electrode superconducting wire comprises a second base material, a second oxide superconducting layer which is provided on the second base material, and a second stabilizing layer which is provided on the second oxide superconducting layer, wherein the first stabilizing layer is solder-joined to face the first surface of the electrode member, and wherein the second stabilizing layer is solder-joined to face the second surface of the electrode member.

6. The superconducting coil according to claim 1, wherein an outer periphery of the electrode superconducting wire is coated with copper.

7. The superconducting coil according to claim 1, wherein the superconducting wire of the coil body is joined to the electrode member by a first solder member, wherein the electrode member is joined to the electrode superconducting wire by a second solder member, and wherein a melting point of the first solder member is different from a melting point of the second solder member.

8. The superconducting coil according to claim 1, wherein the width (W2) of the base portion is constant along the length of the base portion.

9. The superconducting coil according to claim 1, wherein the width (W2) of the base portion is equal to the width of the extension portion.

10. The superconducting coil according to claim 1, wherein the electrode superconducting wire is only in electrical contact with the coil body via the electrode member.

11. The superconducting coil according to claim 1, wherein the superconducting wire of the coil body only contacts the electrode member at the first surface of the base portion.

* * * * *